US008523463B2

(12) United States Patent
Silberbauer et al.

(10) Patent No.: US 8,523,463 B2
(45) Date of Patent: Sep. 3, 2013

(54) METHOD AND APPARATUS FOR PRODUCING PRINTED PRODUCTS

(75) Inventors: Guenther Silberbauer, Uerkheim (CH); Markus Bracher, Rothrist (CH)

(73) Assignee: Mueller Martini Holding AG, Hergiswil (CH)

( * ) Notice: Subject to any disclaimer, the term of this patent is extended or adjusted under 35 U.S.C. 154(b) by 761 days.

(21) Appl. No.: 12/372,540

(22) Filed: Feb. 17, 2009

(65) Prior Publication Data

US 2009/0208268 A1 Aug. 20, 2009

(30) Foreign Application Priority Data

Feb. 18, 2008 (EP) ..... 08405048

(51) Int. Cl.
*B41J 1/00* (2006.01)

(52) U.S. Cl.
USPC ..... 400/103

(58) Field of Classification Search
USPC ..... 400/103
See application file for complete search history.

(56) References Cited

U.S. PATENT DOCUMENTS

2005/0270357 A1* 12/2005 Kawai ..... 347/105

FOREIGN PATENT DOCUMENTS

| | | | |
|---|---|---|---|
| DE | 10 2005 009301 | A1 | 9/2006 |
| EP | 0 439 257 | A2 | 7/1991 |
| EP | 0 895 872 | A1 | 2/1999 |
| EP | 1 816 007 | A | 8/2007 |
| JP | 63-154378 | | 6/1988 |
| WO | WO 2005072980 | A2 * | 8/2005 |

OTHER PUBLICATIONS

European Search Report dated Oct. 7, 2008 issued in Priority Application No. 08405036.8-13251.

Japanese Office Action dated Mar. 25, 2013 for Japanese Patent Application No. 2009-034668.

* cited by examiner

*Primary Examiner* — Michael G Lee
*Assistant Examiner* — Matthew Mikels
(74) *Attorney, Agent, or Firm* — Venable LLP; Robert Kinberg

(57) ABSTRACT

A method for producing at least one printed product, the method including conveying the printed product to a processing apparatus, wherein the printed product includes a detectable identification code. The method further includes supplying the printed product to at least one tool of the processing apparatus and processing the printed product with the at least one tool. The processing includes detecting data, with a reading device, from the detectable identification code on the printed product and transmitting the data to a control unit. The processing further includes controlling, by the control unit, the at least one tool to process the printed product in dependence of the transmitted data.

11 Claims, 2 Drawing Sheets

METHOD AND APPARATUS FOR PRODUCING PRINTED PRODUCTS

CROSS-REFERENCE TO RELATED APPLICATION

This application claims the priority to European Patent Application No. 08405048.3, filed on Feb. 18, 2008, the subject matter of which is incorporated herein by reference.

BACKGROUND OF THE INVENTION

The invention relates to a method for producing printed products with the aid of a processing apparatus, which is provided with at least one tool for processing respectively one printed product, as well as a conveying device for supplying the printed products to the at least one tool, wherein the individual printed products being conveyed to the processing apparatus are provided with a detectable identification code, for which the data can be detected with a readout device and can be used for processing the printed products. The invention furthermore relates to an apparatus for realizing the method.

A method of the aforementioned type is disclosed in European patent document EP-A-1 816 007, which is commonly owned by the assignee of the present application. In that case, the printed products are book blocks that are provided with adhesive on the back and are encased in jackets inside a processing apparatus. Several different types of jackets are made available, so that the individual book blocks can be provided with the jacket assigned to them. To ensure an uninterrupted flow for the processing and to provide the individual book blocks with the respectively required jacket, an identification code is applied to the jackets while these are conveyed to the processing apparatus. The data contained in these identification codes are supplied to a super-imposed control unit, which is connected to a detection station and an input station.

The method disclosed therein is intended to be used in particular for printed products that are printed sequentially by a digital printer. Once the book blocks are provided with the corresponding jackets, they are supplied to a trimming device in which they are trimmed to the required format. A comparably involved "work flow," however, is necessary for realizing this method.

SUMMARY

It is therefore an object of the present invention to create a method of the aforementioned type, which makes it possible to have an even higher output, especially for producing small print editions.

The above and other objects are accomplished according to one aspect of the invention wherein there is provided a method for producing at least one printed product, the method including conveying the printed product to a processing apparatus, wherein the printed product includes a detectable identification code; supplying the printed product to at least one tool of the processing apparatus; and processing the printed product with the at least one tool, wherein the processing includes: detecting data, with a reading device, from the detectable identification code on the printed product, and transmitting the data to a control unit; and controlling, by the control unit, the at least one tool to process the printed product in dependence of the transmitted data.

As a result of the invention, each printed product is respectively processed on the basis of the data encoded in its own identification code. The method according to the invention thus permits a dynamic and local processing without "work flow" and super-imposed control.

For example, the inventive method makes it possible to trim each printed product to a format that is specifically assigned to it, thereby making it unnecessary for all printed products of a single work order to be trimmed to the same format. Different printed products can furthermore be produced sequentially, for example books having different formats. Based on the identification code assigned to each printed product, the tools are adjusted automatically to the respective format. The control in that case is not a super-imposed control, but a machine control that controls the respective tool and/or the trimming device. For example, the trimming format can be varied cyclically in the processing apparatus, depending on the specified format. The respective data are input at a point that is one or two or more than two cycles prior to the processing operation, for example prior to the bottom cut. The method according to the invention thus permits a more cost-effective sequential production of printed products, for example books having different formats, and also makes possible a higher output.

The processing apparatus in particular is a cutting or trimming device provided with at least one knife. However, the processing apparatus could also comprise a different tool, for example a milling tool, a stitching unit, or an embossing tool. It is furthermore conceivable to realize several different processing operations.

According to one modification of the invention, the identification code contains data relating to a predetermined trimming format, wherein these data are respectively transmitted to the control unit. However, different data can also be transmitted in place of the data relating to a trimming format, for example data relating to different stitching positions.

The method according to the invention is particularly suitable for producing bound printed products, especially books, which can thus be produced cost-effectively and sequentially with different formats.

According to one modification of the invention, the identification codes are respectively provided with a machine-readable coding. Alphanumerical symbols from the American Standard Code for Information Interchange (ASCII) Table can be used for the data coding, thus making it possible to use an extremely space-saving process for encoding the data. Experts in this field also refer to this type of encoding as information compressing.

The identification codes according to a different modification of the invention take the form of a bar code or a two-dimensional data matrix, which can be printed onto an extremely small space, e.g. on a jacket or a book block. The identification codes can also be provided with a different device, for example a transponder containing electronically readable data in a manner known per se.

According to yet another modification of the invention, the identification codes are respectively affixed to a region of the printed product, which is then removed in the processing apparatus, for example by cutting it off. As a result, the finished product does not contain identification codes which may be visually disturbing.

One modification of the invention provides that the device for reading the identification codes is arranged such that the identification codes can be read ahead of time, respectively at a point that is a predetermined number of cycles before the processing cycle. A particularly secure varying of the trimming format is thus possible during each cycle, for example if the identification codes are read just a few cycles prior to the processing step, e.g. one or two cycles before, thereby ensuring in particular that no printed products are removed and the sequence is not changed. It is furthermore conceivable that the information is read several cycles prior to the processing operation and is passed on virtually with the aid of a cycle-by-cycle product tracking. That is to say, the data are stored temporarily and are then transmitted by the control together with the product. The identification codes may be read in the region of the conveying device, which directly supplies the printed products to the processing apparatus.

According to another aspect of the invention there is provided an apparatus for producing at least one printed product, including at least one tool for processing the printed product; a conveying device for supplying the printed product to the at least one tool, wherein an identification code is affixed to the printed product as the printed product is conveyed to the at least one tool; a detecting device for detecting the identification code affixed to the respective printed product; and a control unit coupled to the detecting device, wherein the detecting device transmits data from the identification code to the control unit for a direct control of the at least one tool.

With the apparatus according to the invention, the data mentioned which may be format data are therefore not supplied to a super-imposed control, but are supplied directly to the control unit that controls and/or varies the at least one tool, thereby making it possible to vary, for example, the trimming format for each cycle.

BRIEF DESCRIPTION OF THE DRAWINGS

The present invention will be more readily understood from the following detailed description when read in conjunction with the accompanying drawings, in which.

DETAILED DESCRIPTION

Figure 1:
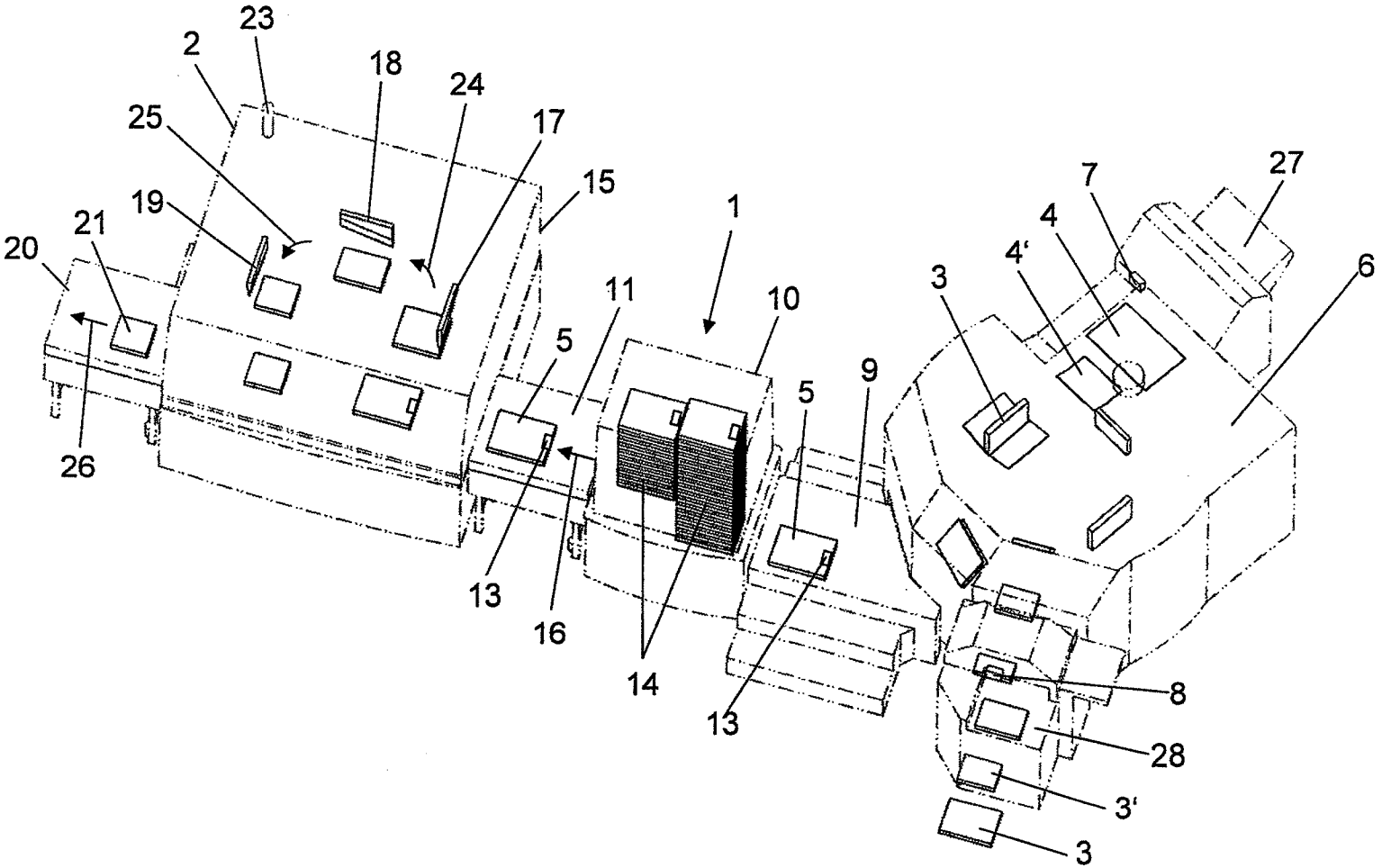
FIG. 1 is a schematic three-dimensional view of an arrangement provided with a perfect binder, a cooling tower, and an apparatus according to an embodiment of the invention.

FIG. 1 shows an arrangement 1 provided with a perfect binder 6, a cooling tower 10, and a processing apparatus 2 in which printed products 5 are trimmed to a predetermined format. The perfect binder 6 comprises a first input station 27 where it is supplied with jackets 4 and/or 4', in particular book jackets. These jackets 4 and/or 4' can have different formats and can furthermore be provided with an identification code, not shown herein, which is read by a first reading device 7. Book blocks 3 and/or 3', which can also have different formats, are supplied at a second input station 28 to the perfect binder 6.

A second reading device 8 is used to read out corresponding identification codes affixed to, e.g. printed onto, the book blocks 3 and/or 3'. The identification codes on the jackets 4 and/or 4' and the book blocks 3 and/or 3' in this case are supplied to a super-imposed control unit that is not shown herein, so that each book block 3 and/or 3' is provided with the jacket 4 and/or 4' assigned to it. The book blocks are processed in a manner known per se in the perfect binder 6, for example they are milled, adhesive is applied, or they are provided with the respective jacket 4 and/or 4'. In place of the perfect binder 6, however, another machine can also be provided, thus making the perfect binder 6 an optional feature of the invention.

The perfect binder 6 is linked with a first conveying device 9 to the cooling tower 10. The printed products 5 that are discharged by the perfect binder 6 are transported with the aid of this conveying device 9 to the cooling tower 10, wherein the printed products 5 can be composed of a book block 3 and/or 3' and a jacket 4 and/or 4'.

Each printed product 5 is provided with an identification code 13 and/or 13', for example containing data relating to a specified trimming format. Inside the cooling tower 10, the printed products 5 are assembled into stacks 14, which are positioned at defined distances to each other. The printed products 5 and/or 5' are then cooled to a specified temperature, so that they can be processed further. The cooling tower 10 is also an optional feature for the invention.

Figure 2:
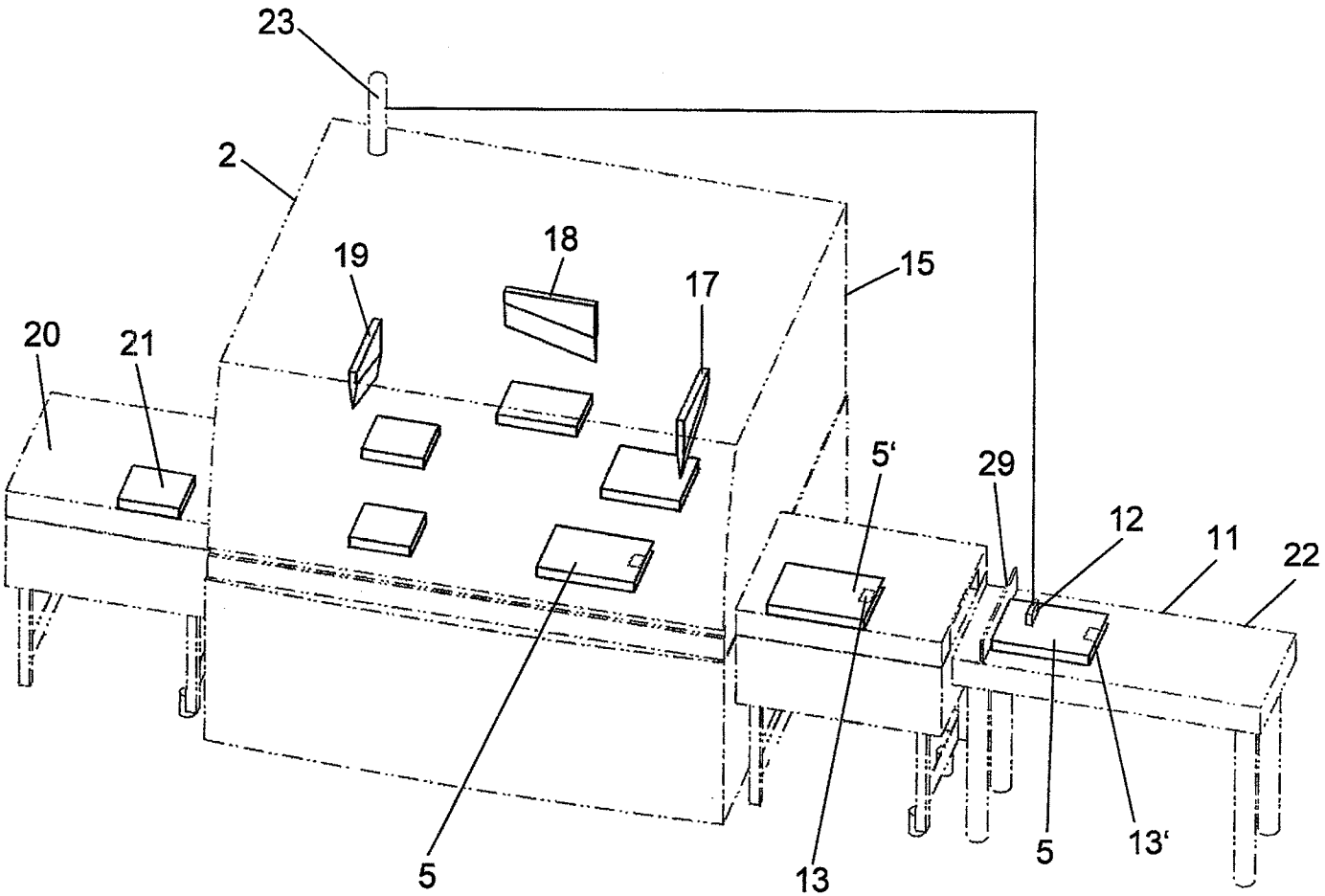
FIG. 2 is a schematic three-dimensional view of the apparatus according to an embodiment of the invention.

The cooled-down printed products 5 are then transported with the aid of a second conveying device 11 from the cooling tower 10 to the processing apparatus 2, wherein FIG. 1 shows that the transport is in the direction of arrow 16. FIG. 2 shows that the conveying device 11 consists of a table 22 with an end stop 29, in front of which a third reading device 12 is arranged.

The identification codes are respectively detected and/or read with this reading device 12. The reading device 12 can be an optical reading device using a line-scanning camera or can also be an electronic detection device. The data can furthermore be read out of a transponder, which is not shown herein. The printed products 5 are supplied, for example cyclically, with the aid of the conveying device 11 to the processing apparatus 2.

Subsequently following printed products 5 and/or 5' can have identification codes 13 and/or 13' that contain different data, for example data relating to trimming formats. The identification code 13', for example, can contain data that differs from the data of the identification code 13 and can relate to different trimming formats. For the embodiment shown herein, the third reading device 12 is located upstream and/or outside of the processing apparatus 2. However, this third reading device 12 could also be arranged inside the processing apparatus 2. Data stored in a transponder can also be read out directly.

The third reading device 12 is connected to a control unit 23 of the processing apparatus 2 for transmitting the data, wherein the data can be transmitted by wire or also non-contacting. The control unit 23 functions as the machine control for the processing apparatus and, in particular, is used to vary between a first trimming knife 17, a second trimming knife 18 and a third trimming knife 19, so that the respective cut can be varied.

The first trimming knife 17 is intended for the bottom cut, the second trimming knife 18 is intended for the frontal cut, and the third trimming knife 19 is intended for the top cut. Within the processing apparatus 2, the printed products 5 and/or 5' are successively fed to the trimming knives 17-19. The transport from the first trimming knife 17 to the second trimming knife 18 is shown in FIG. 1 with the arrow 24 and the transport from the second trimming knife 18 to the third trimming knife 19 is indicated with the arrow 25. One skilled in the art will be familiar with suitable transporting devices and trimming knives 17-19.

Furthermore known is the automatic varying between the trimming knives 17-19, for example with respect to their position. Alternatively, it is also possible to change the respective trimming positions for the printed products 5, for example by adjusting the end stops, not shown herein, on which the printed products 5 and/or 5' are respectively positioned for the cut. Once the top cut is made, the trimmed and generally completely finished printed products 21 are discharged to a discharge table 20 where they can be stacked or laminated, for example with a device not shown herein.

The identification code 13 can be visible to the naked eye or can be invisible. For example, it could be embodied to be visible under UV light, but not under daylight. The identification code 13, for example, may take the form of a bar code or a data matrix. If the identification code 13 is printed onto the jacket 4 and/or 4' or onto the book block 3 and/or 3' or onto a medium to be inserted, it should cover the smallest possible area. The code, which may contain the information on the specified trimming format, could also be part of a more comprehensive code. For example, the code could contain an identification number as well as additional information on the trimming format.

If the printed-on identification code 13 takes the form of a bar code or a data matrix, a coding algorithm that is known per se can be used for the encoding, e.g. for encoding the trimming format, thereby making it possible to save alphanumerical digits and/or space.

It will be understood that the above description of the present invention is susceptible to various modifications, changes and adaptations, and the same are intended to be comprehended within the meaning and range of equivalents of the appended claims.

What is claimed is:

1. An apparatus for producing at least one trimmed printed product, comprising:

at least one tool comprising a trimming device for trimming a printed product, wherein the trimming device comprises a trimming knife and is adjustable to different formats of the printed product;

a conveying device for supplying the printed product to the at least one tool, wherein an identification code is affixed to the printed product being conveyed to the at least one tool;

a detecting device for detecting the identification code affixed to the printed product; and a control unit coupled to the detecting device, wherein the detecting device transmits data detected from the identification code to the control unit, wherein the control unit is coupled to the trimming device and is configured to adjust the trimming device to a predetermined trimming format for the printed product based on the data detected from the identification code on the printed product.

2. The apparatus according to claim 1, wherein the detecting device comprises a reading device for reading and/or detecting the identification code, wherein the identification code is a bar code or a data matrix.

3. The apparatus according to claim 1, wherein the trimming device of the at least one tool is a three-way trimming device, wherein a first trimming knife cuts a bottom cut, a second trimming knife cuts a frontal cut, and a third trimming knife cuts a top cut.

4. A method of producing bound printed products and/or producing books, comprising utilizing the apparatus of claim 1.

5. The apparatus according to claim 1, wherein the data of the identification code comprises data relating to a trimming format of the print product.

6. The apparatus according to claim 1, wherein the identification code includes machine-readable coding, and the detecting device is configured to read the machine-readable coding.

7. The apparatus according to claim 6, wherein the machine-readable coding comprises a bar code or a data matrix.

8. The apparatus according to claim 1, wherein the identification code is printed on the printed product.

9. The apparatus according to claim 1, wherein the identification code is positioned on a region of the printed product to be cut off by the at least one tool.

10. The apparatus according to claim 1, wherein the identification code comprises a transponder in which the data is stored.

11. The apparatus according to claim 1, wherein the detecting device is arranged upstream of the at least one tool for trimming the printed product such that the detecting device detects the identification code at a predetermined number of cycles before reaching the at least one tool.

* * * * *